US010036281B2

(12) United States Patent
McCaffrey

(10) Patent No.: US 10,036,281 B2
(45) Date of Patent: Jul. 31, 2018

(54) MID TURBINE FRAME (MTF) FOR A GAS TURBINE ENGINE

(71) Applicant: United Technologies Corporation, Hartford, CT (US)

(72) Inventor: Michael G. McCaffrey, Windsor, CT (US)

(73) Assignee: United Technologies Corporation, Farmington, CT (US)

( * ) Notice: Subject to any disclaimer, the term of this patent is extended or adjusted under 35 U.S.C. 154(b) by 190 days.

(21) Appl. No.: 14/847,363

(22) Filed: Sep. 8, 2015

(65) Prior Publication Data

US 2015/0377067 A1 Dec. 31, 2015

Related U.S. Application Data

(63) Continuation of application No. 13/275,276, filed on Oct. 17, 2011, now Pat. No. 9,200,536.

(51) Int. Cl.

| | |
|---|---|
| ***F01D 25/24*** | (2006.01) |
| ***F01D 9/04*** | (2006.01) |
| ***F01D 25/16*** | (2006.01) |

(52) U.S. Cl.

CPC ..... *F01D 25/246* (2013.01); *F01D 9/041* (2013.01); *F01D 25/162* (2013.01); *F05D 2220/32* (2013.01); *F05D 2240/15* (2013.01); *F05D 2300/20* (2013.01); *F05D 2300/6033* (2013.01); *Y10T 29/49337* (2015.01)

(58) Field of Classification Search

CPC ..... F01D 25/162; F01D 25/24; F01D 25/246; F01D 5/147; F01D 9/04; F01D 9/041; F01D 9/042; Y10T 29/49337; F05D 2300/6033

See application file for complete search history.

(56) References Cited

U.S. PATENT DOCUMENTS

| | | | | |
|---|---|---|---|---|
| 3,558,237 | A * | 1/1971 | Wall | F01D 17/162 415/115 |
| 4,645,415 | A * | 2/1987 | Hovan | F01D 25/125 415/115 |
| 4,987,736 | A | 1/1991 | Ciokajlo et al. | |
| 5,616,001 | A | 4/1997 | Boyd | |
| 6,000,906 | A | 12/1999 | Draskovich | |
| 7,093,359 | B2 | 8/2006 | Morrison et al. | |
| 7,452,182 | B2 | 11/2008 | Vance et al. | |
| 7,600,979 | B2 * | 10/2009 | Steibel | C04B 35/573 416/229 A |
| 7,753,643 | B2 * | 7/2010 | Gonzalez | F01D 9/04 415/1 |

(Continued)

OTHER PUBLICATIONS

European Search Report for European Patent Application No. 12187969 completed Sep. 22, 2016.

*Primary Examiner* — Woody Lee, Jr.
*Assistant Examiner* — Elton Wong
(74) *Attorney, Agent, or Firm* — Carlson, Gaskey & Olds, P.C.

(57) ABSTRACT

A mid-turbine frame for a gas turbine engine includes a CMC outer ring, a CMC inner ring, and a multiple of CMC airfoils between the CMC outer ring and the CMC inner ring. Each of the CMC airfoils includes at least one hollow tube and a shell of a multiple of CMC plies surrounding the hollow tube. The hollow tube reinforces the shell. A spring biased tie-rod assembly is mounted through at least one of the multiple of CMC airfoils.

18 Claims, 6 Drawing Sheets

(56) References Cited

U.S. PATENT DOCUMENTS

| | | | | |
|---|---|---|---|---|
| 7,824,151 | B2 | 11/2010 | Schwarz et al. | |
| 7,874,059 | B2 | 1/2011 | Morrison et al. | |
| 2005/0169759 | A1 | 8/2005 | Haubert | |
| 2006/0121265 | A1 | 6/2006 | Thompson et al. | |
| 2006/0228211 | A1 | 10/2006 | Vance et al. | |
| 2006/0275111 | A1* | 12/2006 | Orlando | F01D 5/141 415/191 |
| 2008/0060755 | A1 | 3/2008 | Blanton et al. | |
| 2008/0279679 | A1* | 11/2008 | Morrison | F01D 9/042 415/191 |
| 2010/0068034 | A1 | 3/2010 | Schiavo et al. | |
| 2010/0189556 | A1 | 7/2010 | Propheter-Hinckley et al. | |
| 2010/0200189 | A1 | 8/2010 | Qi et al. | |
| 2011/0079019 | A1 | 4/2011 | Durocher et al. | |

* cited by examiner

MID TURBINE FRAME (MTF) FOR A GAS TURBINE ENGINE

CROSS-REFERENCE TO RELATED APPLICATION

The present disclosure is a continuation of U.S. patent application Ser. No. 13/275,276, filed Oct. 17, 2011.

BACKGROUND OF THE INVENTION

The present disclosure relates to a gas turbine engine, and more particularly to Ceramic Matrix Composite (CMC) static structure thereof.

In a turbine section of a gas turbine engine, tie rods typically extend between an annular outer case structure and an annular inner case structure of a core path through which hot core exhaust gases are communicated. Each tie rod is often shielded by a respective high temperature resistant cast metal alloy aerodynamically shaped fairing.

SUMMARY OF THE INVENTION

A mid-turbine frame for a gas turbine engine according to an example of the present disclosure includes a CMC outer ring, a CMC inner ring, and a multiple of CMC airfoils between the CMC outer ring and the CMC inner ring. Each of the CMC airfoils includes at least one hollow tube and a shell of a multiple of CMC plies surrounding the hollow tube. The hollow tube reinforces the shell, and a spring biased tie-rod assembly is mounted through at least one of the multiple of CMC airfoils.

A further embodiment of any of the foregoing embodiments includes a support tie-rod fastened to an annular inner turbine exhaust case and an annular outer turbine exhaust case, the support tie-rod mounted through at least one of the multiple of CMC airfoils.

In a further embodiment of any of the forgoing embodiments, the spring biased tie-rod assembly includes a tie rod formed of a monolithic ceramic material.

In a further embodiment of any of the forgoing embodiments, the tie rod includes a flared end section.

In a further embodiment of any of the forgoing embodiments, the flared end section is frustro-conical.

In a further embodiment of any of the forgoing embodiments, the spring biased tie-rod assembly includes a tie rod formed of a ceramic matrix composite material.

In a further embodiment of any of the forgoing embodiments, the tie rod includes a flared end section.

In a further embodiment of any of the forgoing embodiments, the flared end section is frustro-conical.

In a further embodiment of any of the forgoing embodiments, the hollow tube is formed of a ceramic material.

In a further embodiment of any of the forgoing embodiments, the hollow tube abuts an interior surface of the shell.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
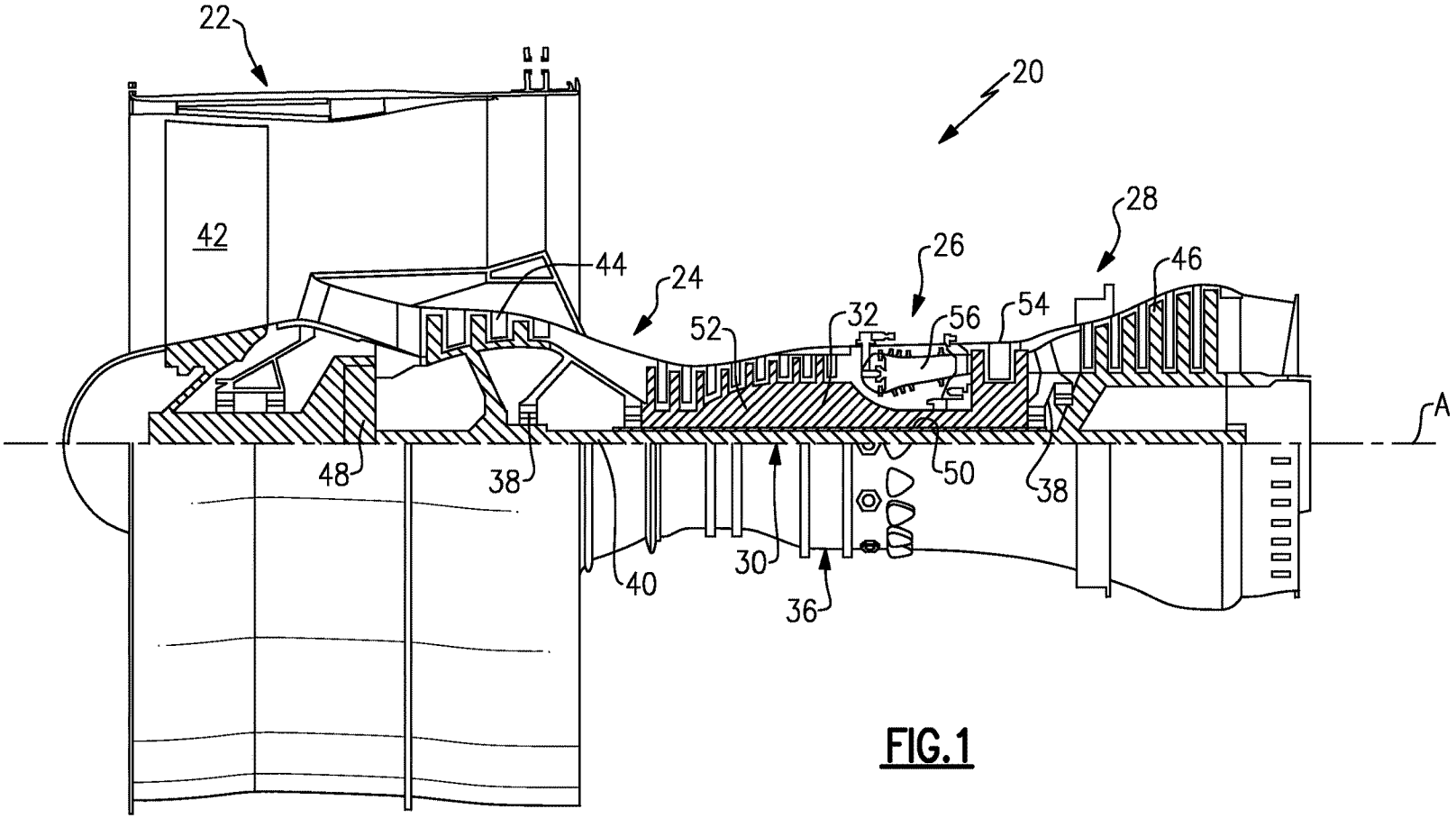
FIG. 1 is a schematic cross-section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 54, 46 rotationally drive the respective low speed spool 30 and high speed spool 32 in response to the expansion.

Figure 2:
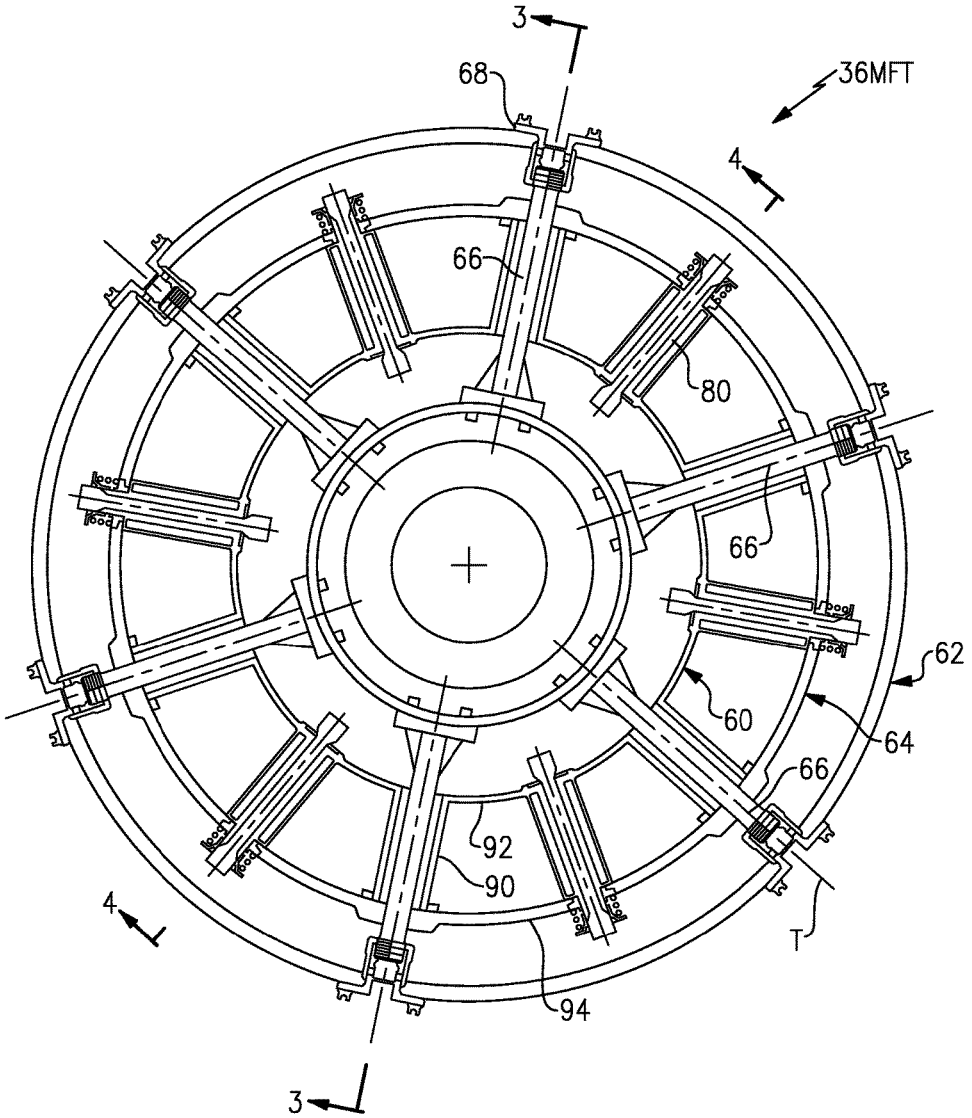
FIG. 2 is a front sectional view of the mid-turbine frame (MTF)
Figure 3:
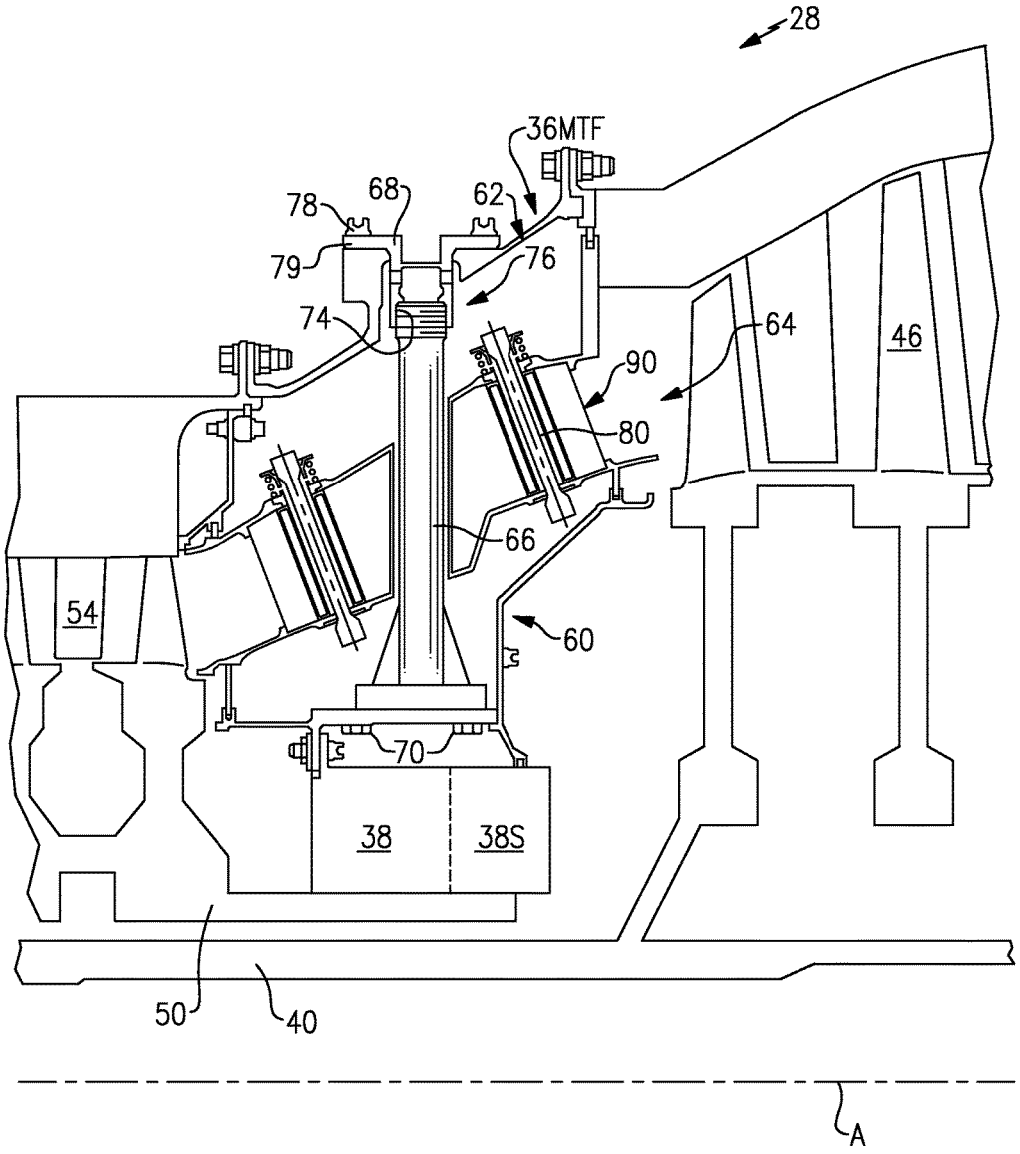
FIG. 3 is an enlarged sectional view of a Turbine section of the gas turbine engine to show a support tie rod which supports a mid-turbine frame (MTF)
Figure 4:
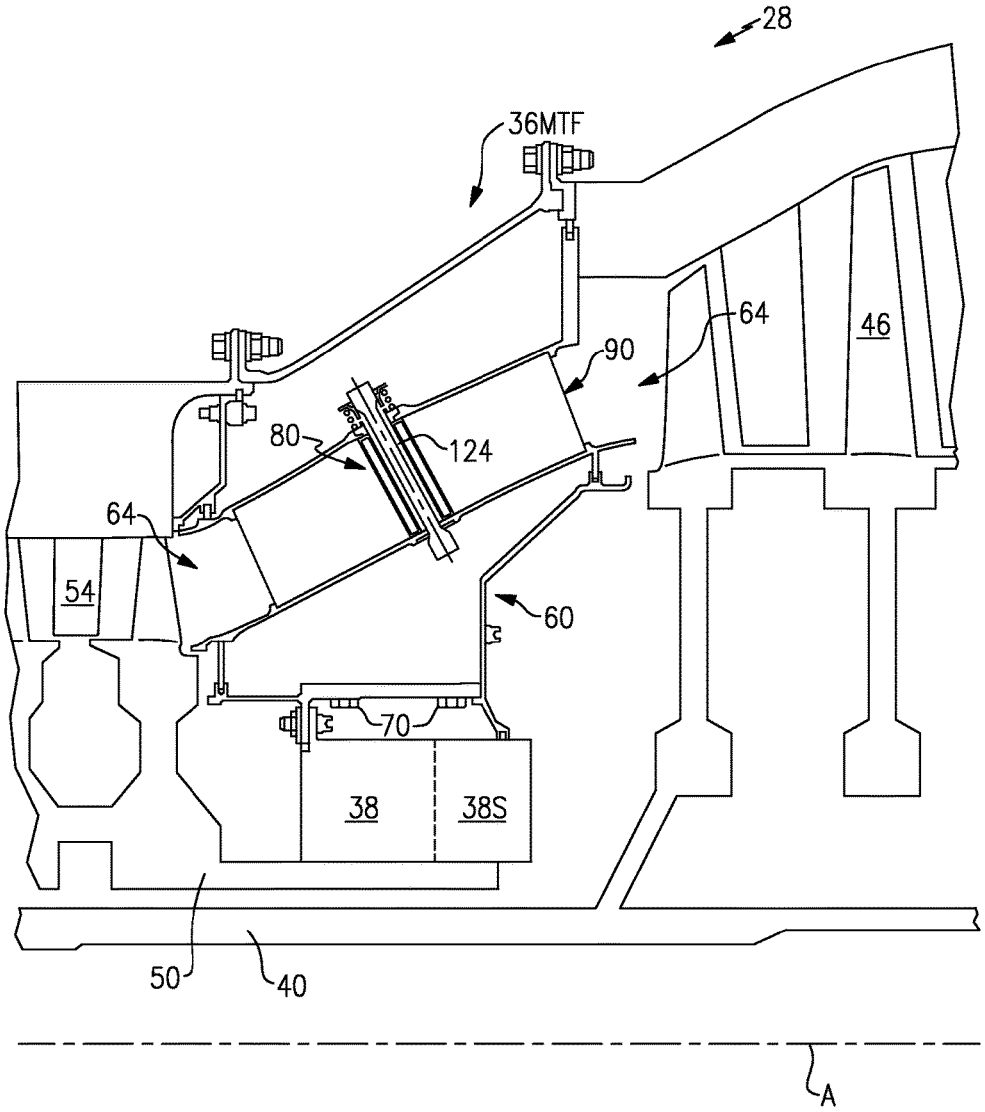
FIG. 4 is an enlarged sectional view of the Turbine section of the gas turbine engine without a support tie rod.

With reference to FIG. 2, the turbine section 28 generally includes static case structure 36MTF which is disclosed herein as a mid-turbine section of the gas turbine engine 20. The static structure 36MTF includes an annular inner turbine exhaust case 60, an annular outer turbine exhaust case 62, a mid-turbine frame (MTF) 64, a multiple of support tie rods 66, a respective multiple of tie rod nuts 68 and a multiple of spring biased tie-rod assemblies 80 (FIGS. 3 and 4). The annular inner turbine exhaust case 60 typically supports a bearing system 38 as well as other components such as seal cartridge structures 38S within which the inner and outer shafts 40, 50 rotate.

With respect to FIG. 3, the support tie rods 66 are utilized to mount the mid-turbine frame 64 within the annular inner turbine exhaust case 60 and the annular outer turbine exhaust case 62. Each of the support tie rods 66 may be fastened to the annular inner turbine exhaust case 60 through a multiple of fasteners 70 such that the annular outer turbine exhaust case 62 is spaced relative thereto. Each of the support tie rods 66 are fastened to the annular outer turbine exhaust case 62 by the respective tie rod nut 68 which is threaded via an inner diameter thread 72 to an outer diameter thread 74 of an end section 76 of each support tie rod 66. Each tie rod nut 68 is then secured to the annular outer turbine exhaust case 62 with one or more fasteners 78 which extend thru holes 79 in the tie rod nut 68 as generally understood. It should be understood that various attachment arrangements may alternatively or additionally be utilized.

The mid-turbine frame (MTF) 64 generally includes a multiple of airfoils 90, an inner ring 92, and an outer ring 94 manufactured of a ceramic matrix composite (CMC) material typically in a ring-strut ring full hoop structure. The inner ring 92 and the outer ring 94 utilize the hoop strength characteristics of the CMC to form a full hoop shroud in a ring-strut-ring structure. The term full hoop is defined herein as an uninterrupted member which surround the airfoils. It should be appreciated that examples of CMC material for componentry discussed herein may include, but are not limited to, for example, S200 and SiC/SiC. Although depicted as a mid-turbine frame (MTF) 64 in the disclosed embodiment, it should also be understood that the concepts described herein may be applied to other sections such as high pressure turbines, high pressure compressors, low pressure compressors, as well as intermediate pressure turbines and intermediate pressure compressors of a three-spool architecture gas turbine engine.

Figure 5:
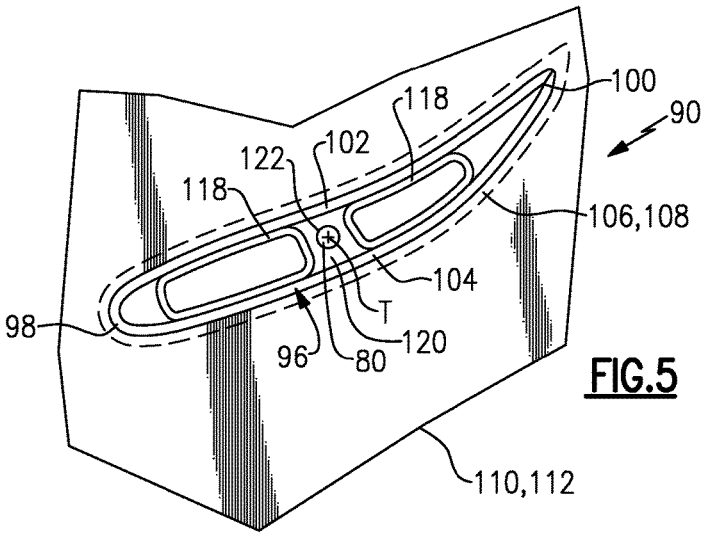
FIG. 5 is a lateral sectional view of a vane for the mid-turbine frame (MTF)

With reference to FIG. 5, each airfoil 90 generally includes an airfoil portion 96 with a generally concave shaped portion which forms a pressure side 102 and a generally convex shaped portion which forms a suction side 104 between a leading edge 98 and a trailing edge 100. Each airfoil portion 96 may include a fillet section 106, 108 to provide a transition between the airfoil portion 96 and a platform segment 110, 112. The platform segment 110, 112 may include unidirectional plys which are aligned tows with or without weave, as well as additional or alternative fabric plies to obtain a thicker platform segment if so required. The platform segment 110, 112 are surrounded by the inner ring 92 and the outer ring 94.

In the disclosed non-limiting embodiment, either or both of the platform segments segment 110, 112 may be of a circumferential complementary geometry such as a chevron-shape to provide a complementary abutting edge engagement for each adjacent platform segment to define the inner and outer core gas path. That is, the airfoil 90 are assembled in an adjacent complementary manner with the respectively adjacent platform segments 110, 112 to form a full hoop unitary structure to form a ring of airfoils which are then surrounded by the inner ring 92 and outer ring 94 (FIGS. 3 and 4).

The pressure side 102 and the suction side 104 may be formed from a respective multiple of CMC plies formed around or along a pressure vessel 118 and an insert 120. That is, the pressure vessel 118 and the insert 120 provide internal support structure within the airfoil portion 96. This internal support structure may be located in each or only some of the airfoil portions 96.

The pressure vessel 118 may be formed as a monolithic ceramic material such as a silicon carbide, silicon nitride or alternatively from a multiple of CMC plies which are wrapped to form a hollow tube in cross-section. The pressure vessel 118 strengthens the CMC airfoil 90 to resist the differential pressure generated between the core flow along the airfoil portion 96 and the secondary cooling flow which may be communicated through the airfoil portion 96. It should be appreciated that other passages may be formed through the mid-turbine frame (MTF) 64 separate from the airfoils 90 to provide a path for wire harnesses, conduits, or other systems.

The insert 120 may also be formed as a monolithic or a multiple of CMC plies to define an aperture 122 to receive the spring biased tie-rod assemblies 80 (FIG. 6) which apply a compressive force to the mid-turbine frame (MTF) 64. That is, the insert 120 operates to reinforce the airfoil portion 96 and react the compressive force generated by the spring biased tie-rod assemblies 80. It should be appreciated that the spring biased tie-rod assembly 80 may be oriented in an opposite or alternative direction.

Figure 6:
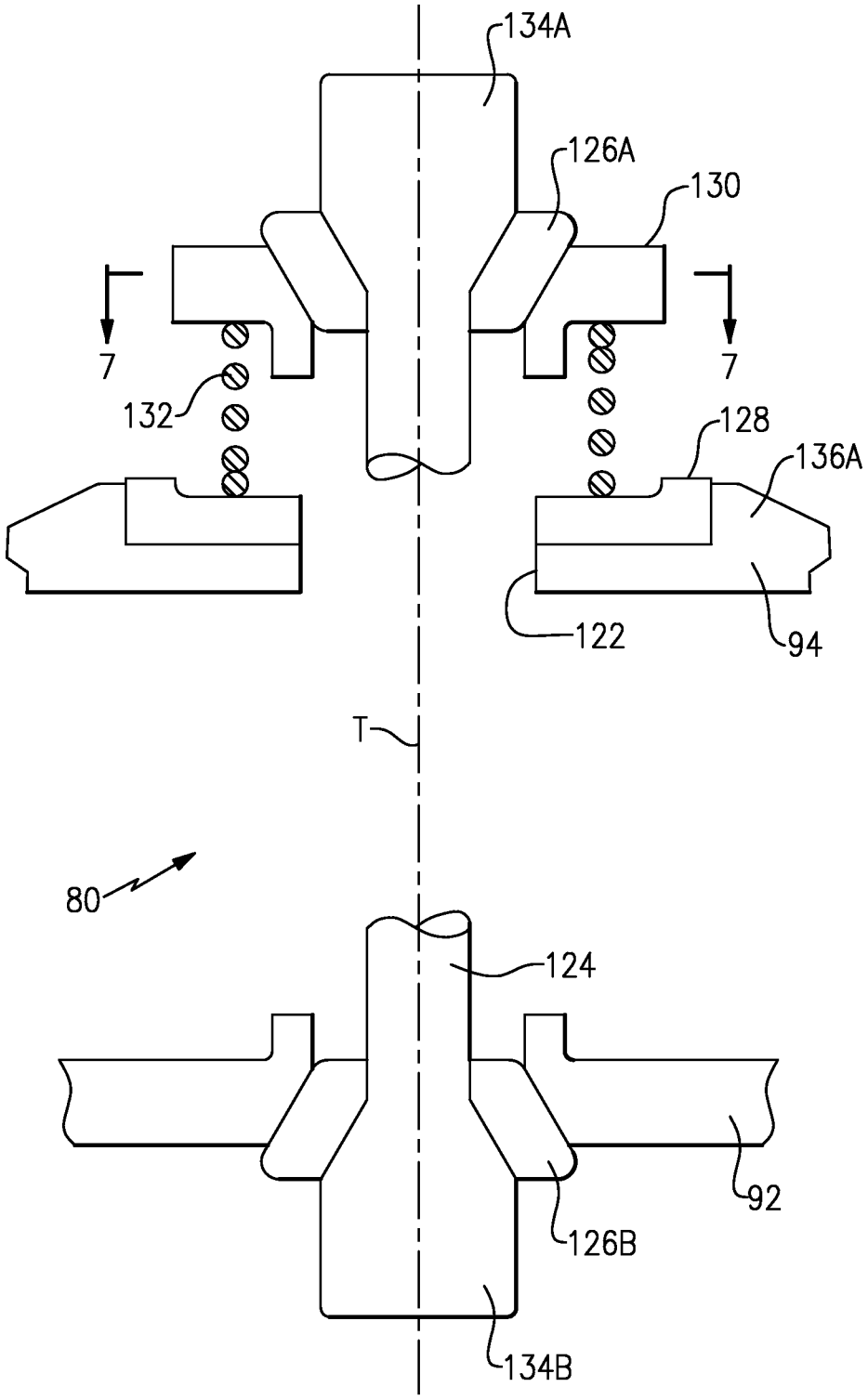
FIG. 6 is a sectional view of a spring biased tie rod assembly.

With reference to FIG. 6, each of the spring biased tie-rod assemblies 80 generally include a tie rod 124, a split retainer 126A, 126B, a spring seat 128, 130, and a spring 132. The tie rod 124 may be manufactured of monolithic ceramic material with flared end sections 134A, 134B which may be frustro-conical. The tie-rod 124 may alternatively be formed of a tow which is a collection of fibers such as a silicon based fiber, a uni-tape, or cloth that is formed as a tube or rod along a longitudinal axis T of the tie-rod 124. The tie rod 124 mounts through the insert 120 along a longitudinal axis T. The split retainer 126A, 126B and the spring seat 128, 130 may be manufactured of a low thermal conductivity material such as the monolithic ceramic materials.

Figure 7:
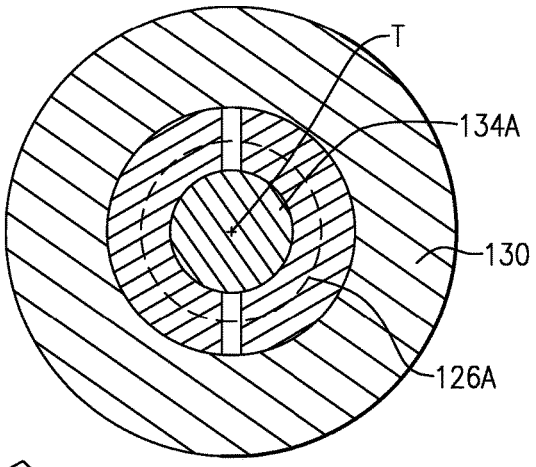
FIG. 7 is a top view of a spring bias end section.
Figure 8:
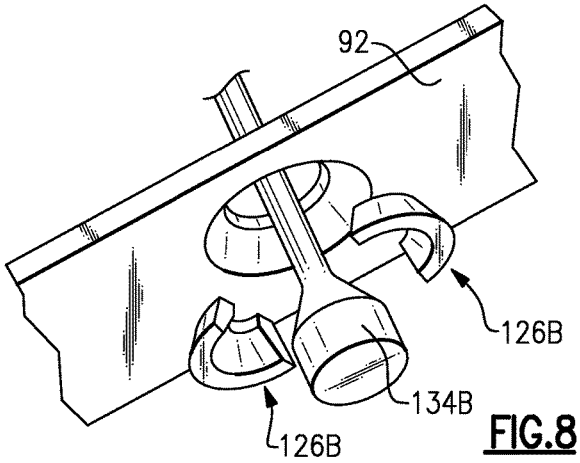
FIG. 8 is an exploded view of a non-spring biased end section.

The end sections 134A, 134B interface with the split retainers 126A, 126B (also shown in FIGS. 7 and 8).

The split ring 126B and the spring seal 128 are received within a reinforced pocket 136A, 136B formed in the respective outer ring 94 and inner ring 92. The reinforced pocket 136 may be formed by a localized ply buildup that may be, for example between 1.5-2 times the nominal thickness of the outer ring 94. The split retainer 126A abuts the flared end section of the spring seat 130 and is thereby trapped therein.

The spring seat 128 is also received within a respective reinforced pocket 136B formed in the outer ring 94 which may also be formed by a localized ply buildup similar to that of the inner ring 92. The spring seat 128, 130 are formed as full rings.

The spring 132 is captured by the spring seats 128, 130 to maintain the split retainer 126A together to generate a tension along the axis T. The tension along the tie rod 124 thereby maintains the mid-turbine frame (MTF) 64 in compression and to essentially clamp the CMC airfoils 90 between the CMC inner ring 92 and the CMC outer ring 94. The spring 132 creates a preload on the tie-rod 124 so that it is always in tension. The MTF assembly, therefore, is always in compression, regardless of the thermal expansion and pressure loads. Such compression reduces the potential for delamination and minimize the stress riser associated with the displaced layers as plys in compression, or otherwise constrained, are less likely to delaminate at a given load. The compression also reduces the leakage between the airfoil and the inner and outer rings.

A large axial pressure load typically exists across the mid-turbine case due to higher pressure upstream in the high pressure turbine 54 (HPT) versus the lower pressures downstream in the low pressure turbine 46 (LPT). The spring biased tie-rod assemblies 80 provide a truss like structure that more effectively resists this load (and reduces axial deflection). Reductions in the axial deflection limits as well as provision of a unitary mid-turbine frame (MTF) 64 facilitates centering of the bearing rolling elements on their races in the bearing systems 38 as well as provide a leak-proof annular structure. It should be understood that only a few support tie rods 66 may be required as compared to the spring biased tie rod assemblies 80 which may be located in each and every CMC airfoil 90. That is, some CMC airfoils 90 may include both a support tie rod 66 and a spring biased tie rod assembly 80.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A mid-turbine frame for a gas turbine engine comprising:

a ceramic matrix composite (CMC) outer ring having a reinforced pocket;

a CMC inner ring;

a multiple of CMC airfoils between said CMC outer ring and said CMC inner ring, each of said CMC airfoils including at least one hollow tube and a shell of a multiple of CMC plies surrounding said at least one hollow tube, said at least one hollow tube reinforcing said shell; and first and second spring seats, said first spring seat disposed in said reinforced pocket and said second spring seat radially-spaced from said first spring seat;

a spring disposed between said first and second spring seats; and a tie-rod extending through said reinforced pocket, said spring, said first and second spring seats, and one of said multiple of CMC airfoils such that said spring and said first and second spring seats generate a tension along said tie-rod.

2. The mid-turbine frame as recited in claim 1, further comprising a support tie-rod fastened to an annular inner turbine exhaust case and an annular outer turbine exhaust case, said support tie-rod mounted through at least one of said multiple of CMC airfoils.

3. The mid-turbine frame as recited in claim 1, wherein said tie-rod is formed of a monolithic ceramic material.

4. The mid-turbine frame as recited in claim 3, wherein said tie-rod includes a flared end section.

5. The mid-turbine frame as recited in claim 4, wherein said flared end section is frustro-conical.

6. The mid-turbine frame as recited in claim 1, wherein said tie-rod is formed of a ceramic matrix composite material.

7. The mid-turbine frame as recited in claim 6, wherein said tie-rod includes a flared end section.

8. The mid-turbine frame as recited in claim 7, wherein said flared end section is frustro-conical.

9. The mid-turbine frame as recited in claim 1, wherein said at least one hollow tube is formed of a ceramic material.

10. The mid-turbine frame as recited in claim 1, wherein said at least one hollow tube abuts an interior surface of said shell.

11. The mid-turbine frame as recited in claim 1, wherein said reinforced pocket is formed into said outer ring.

12. The mid-turbine frame as recited in claim 11, wherein said reinforced pocket is formed by a localized ply buildup in said outer ring.

13. The mid-turbine frame as recited in claim 12, wherein said reinforced pocket has a thickness of between 1.5 and 2 times a nominal thickness of said outer ring.

14. The mid-turbine frame as recited in claim 11, wherein said tie-rod includes a flared end section radially outside said outer ring.

15. The mid-turbine frame as recited in claim 14, wherein said flared end section is received in a frustro-conical retainer ring.

16. The mid-turbine frame as recited in claim 11, wherein said at least one hollow tube includes two hollow tubes surrounded by said shell and reinforcing said shell.

17. The mid-turbine frame as recited in claim 11, wherein a portion of said airfoils include a support tie-rod, said support tie-rod is fastened to an annular inner turbine exhaust case and an annular outer turbine exhaust case.

18. The mid-turbine frame as recited in claim 11, wherein said multiple of CMC plies are wrapped around said at least one hollow tube.

* * * * *